US009246213B2

(12) United States Patent
Togashi

(10) Patent No.: US 9,246,213 B2
(45) Date of Patent: Jan. 26, 2016

(54) ELECTRONIC DEVICE

(75) Inventor: Daisuke Togashi, Kanagawa (JP)

(73) Assignee: KYOCERA Corporation, Kyoto (JP)

( * ) Notice: Subject to any disclaimer, the term of this patent is extended or adjusted under 35 U.S.C. 154(b) by 768 days.

(21) Appl. No.: 13/333,725

(22) Filed: Dec. 21, 2011

(65) Prior Publication Data

US 2012/0162033 A1 Jun. 28, 2012

(30) Foreign Application Priority Data

Dec. 24, 2010 (JP) ..... 2010-287036

(51) Int. Cl.

| | |
|---|---|
| ***H01Q 1/24*** | (2006.01) |
| ***H01Q 7/00*** | (2006.01) |
| ***H01Q 9/30*** | (2006.01) |
| ***H01Q 5/378*** | (2015.01) |

(52) U.S. Cl.

CPC ..... *H01Q 1/243* (2013.01); *H01Q 5/378* (2015.01); *H01Q 7/00* (2013.01); *H01Q 9/30* (2013.01)

(58) Field of Classification Search

CPC ..... H01Q 1/243; H01Q 1/38; H01Q 9/0421

USPC ..... 343/702

See application file for complete search history.

(56) References Cited

U.S. PATENT DOCUMENTS

| | | | | |
|---|---|---|---|---|
| 2002/0135568 | A1* | 9/2002 | Chen | 345/173 |
| 2004/0183788 | A1* | 9/2004 | Kurashima et al. | 345/173 |
| 2005/0153107 | A1* | 7/2005 | Iijima | 428/195.1 |
| 2008/0100522 | A1* | 5/2008 | Inaba et al. | 343/713 |
| 2009/0267861 | A1* | 10/2009 | Abramov et al. | 343/878 |
| 2010/0182207 | A1* | 7/2010 | Miyata et al. | 343/702 |
| 2010/0259515 | A1* | 10/2010 | Kohara | 345/204 |
| 2010/0302110 | A1* | 12/2010 | Leem | 343/702 |
| 2011/0285659 | A1 | 11/2011 | Kuwabara et al. | |

FOREIGN PATENT DOCUMENTS

| | | | |
|---|---|---|---|
| JP | 2001-166883 | A | 6/2001 |
| JP | 2002-215330 | A | 8/2002 |
| JP | 2004-005516 | A | 1/2004 |
| JP | 2004-234270 | A | 8/2004 |
| JP | 2010-181934 | A | 8/2010 |

OTHER PUBLICATIONS

An Office Action; "Notice of Reason for Rejection," issued by the Japanese Patent Office on Aug. 5, 2014, which corresponds to Japanese Patent Application No. 2010-287036 and is related to U.S. Appl. No. 13/333,725; with English language concise explanation.

* cited by examiner

*Primary Examiner* — Dameon E Levi
*Assistant Examiner* — Collin Dawkins
(74) *Attorney, Agent, or Firm* — Studebaker & Brackett PC

(57) ABSTRACT

An electronic device includes: an antenna; and a touch panel having an electrode sheet formed with an operation detecting pattern, which has conductive, wherein an antenna pattern configuring the antenna is formed on the periphery of the touch panel.

8 Claims, 11 Drawing Sheets

ELECTRONIC DEVICE

CROSS-REFERENCE TO RELATED APPLICATION

This application claims priority from Japanese Patent Application No. 2010-287036 filed on Dec. 24, 2010, the entire subject matter of which is incorporated herein by reference.

TECHNICAL FILED

This disclosure relates to an electronic device having a touch panel and an antenna.

BACKGROUND

A back ground electronic device includes a housing, a touch panel having both a display unit to display an image and a detection unit to detect a touch, and an antenna disposed within the housing (see, for example, JP-A-2010-181934).

In the electronic device such as JP-A-2010-181934, the touch panel is to be larger in order to improve the visibility, for example. Accordingly, in such an electronic device, the position where the antenna is disposed may be restricted due to the position of the touch panel disposed within the housing.

In view of the above, this disclosure provides an electronic device in which a positional restriction of the antenna is reduced.

SUMMARY

An electronic device of this disclosure comprises: an antenna; and a touch panel having an electrode sheet formed with an operation detecting pattern, which has conductive, wherein an antenna pattern configuring the antenna is formed on the periphery of the touch panel.

In the above electronic device, the antenna pattern may be formed in an outer area of the operation detecting pattern on the electrode sheet.

The above electronic device may comprise a reference potential unit formed between the operation detecting pattern and the antenna pattern.

The above electronic device may comprise a parasitic element disposed at an outer area of the antenna pattern on the electrode sheet.

The above electronic device may comprise a magnetic material, wherein the magnetic material may be disposed at a position overlapping with the antenna pattern in a thickness direction of the touch panel, and wherein the antenna pattern may be formed to have a loop shape along the periphery of the touch panel.

In the above electronic device, wherein the antenna pattern may include a first antenna pattern and a second antenna pattern, and wherein the electronic device may include a control unit that switches a destination of power supply between the first antenna pattern and the second antenna pattern based on a operation position detected by the operation detecting pattern.

In the above electronic device, wherein the touch panel may include a first sheet and a second sheet that are laminated on the electrode sheet, wherein the antenna pattern may be configured by: a first antenna pattern formed on the first sheet; and a second antenna pattern formed on the second sheet, and wherein the first antenna pattern may be electrically connected with the second antenna pattern.

In the above electronic device, wherein the electrode sheet may include: a first electrode sheet formed with a first operation detecting pattern; and a second electrode sheet formed with a second operation detecting pattern, wherein the first operation detecting pattern detects an operation position in a first direction along a planar direction of the electrode sheet, and the second operation detecting pattern detects the operation position in a second direction, which is different from the first direction, along the planar direction of the electrode sheet, and wherein the antenna pattern is configured by: a first antenna pattern formed on the first electrode sheet; and a second antenna pattern formed on the second electrode sheet, wherein the first antenna pattern is electrically connected to the second antenna pattern.

The above electronic device may comprise a housing formed with an opening, wherein at least one area of the touch panel may be overlapped with the opening in a thickness direction of the touch panel, and wherein the antenna pattern may be formed in another area of the touch panel, which is overlapped with the housing in the thickness direction of the touch panel.

According to this disclosure, it is possible to reduce a positional restriction of the antenna.

BRIEF DESCRIPTION OF THE DRAWINGS

The foregoing and additional features and characteristics of this disclosure will become more apparent from the following detailed descriptions considered with the reference to the accompanying drawings, wherein.

DETAILED DESCRIPTION

Figure 1:
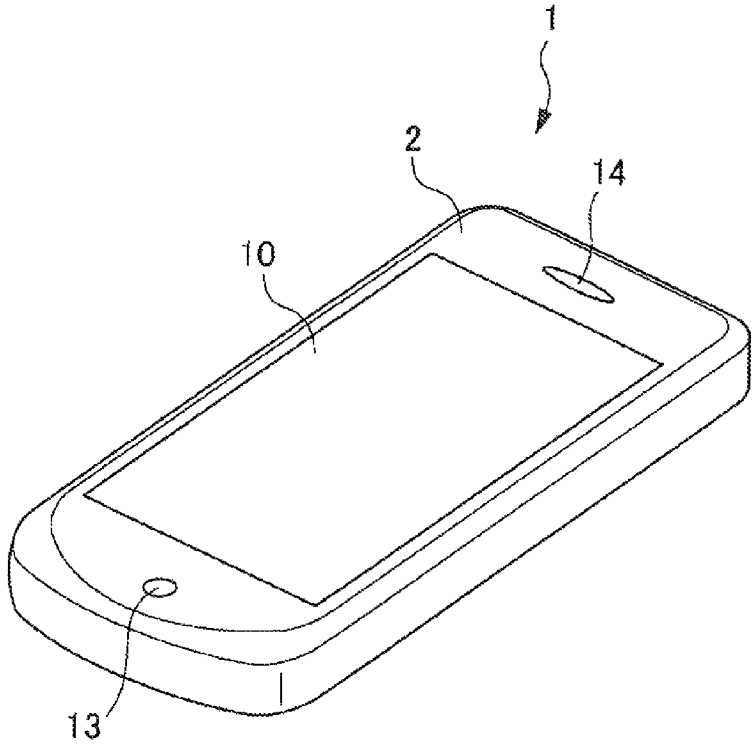
FIG. 1 is a perspective view illustrating an appearance of a mobile phone according to an illustrative embodiment.

Hereinafter, an illustrative embodiment of this disclosure will be described. First, with reference to FIG. 1, it will be described that a basic structure of a mobile phone 1 according to an illustrative embodiment of an electronic device of this disclosure. FIG. 1 is a perspective view illustrating the appearance of the mobile phone 1 according to the illustrative embodiment.

The mobile phone 1 includes a housing 2. A touch panel 10, a microphone 13, and a receiver 14 are disposed on a front face of the housing 2.

Figure 2:
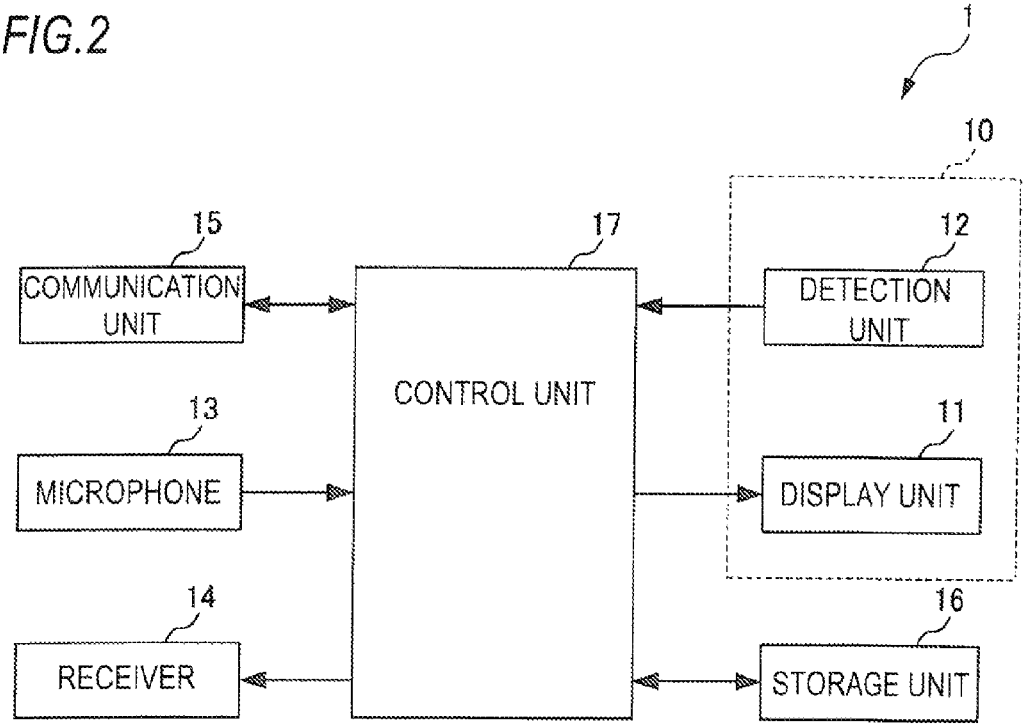
FIG. 2 is a functional block diagram illustrating functions of a mobile phone according to the illustrative embodiment.

The touch panel 10 includes a display unit 11 and a detection unit 12 (see FIG. 2). The display unit 11 is a display panel configured by liquid crystal or organic electro luminescent (EL) materials. The detection unit 12 detects a touch of an object such as a finger or a touch pen onto the display unit 1. The detection unit 12 is disposed to correspond to the surface of the display unit 11. For example, a capacitive type or a resistive type may be employed as the detection unit 12.

The microphone 13 is used to input a voice spoken by the user of the mobile phone 1 when the user speaks over the mobile phone 1. The receiver 14 is used to output a voice spoken by an intended party.

Hereinafter, a functional configuration of the mobile phone 1 will be described with reference to FIG. 2. FIG. 2 is a block diagram illustrating the functional configuration of the mobile phone 1.

The mobile phone 1 includes the touch panel 10 having the display unit 11 and the detection unit 12, the microphone 13, and the receiver 14, as described above. The mobile phone 1 includes a communication unit 15, a storage unit 16, and a control unit 17.

The communication unit 15 includes a main antenna (not shown) and a radio frequency (RF) circuit unit (not shown) to send a call based on contact information or to perform a communication. The contact information to which the communication unit 15 is sending a call may be an emergency number, for example, a police station or a fire station. A communication target, with which the communication unit 15 performs communication, is an external device that performs transmitting/receiving of calls or mails with the mobile phone 1, or an external device such as an external web server, with which the mobile phone 1 communicates via an Internet access.

The communication unit 15 performs communication with an external device using a specific frequency band. Specifically, the communication unit 15 demodulates a signal received via the main antenna and provides the demodulated signal to the control unit 17. The communication unit 15 modulates the signal provided from the control unit 1 and transmits the modulated signal to an external device (base station) via the main antenna.

The storage unit 16 may include a working memory used for operation processing by the control unit 17. The storage unit 16 stores a single or a plurality of applications or databases that are operated within the mobile phone 1. The storage unit 16 may also function as a detachable external memory.

The control unit 17 controls the overall operation of the mobile phone 1 and, specifically, controls the display unit 11 and the communication unit 15.

Figure 3:
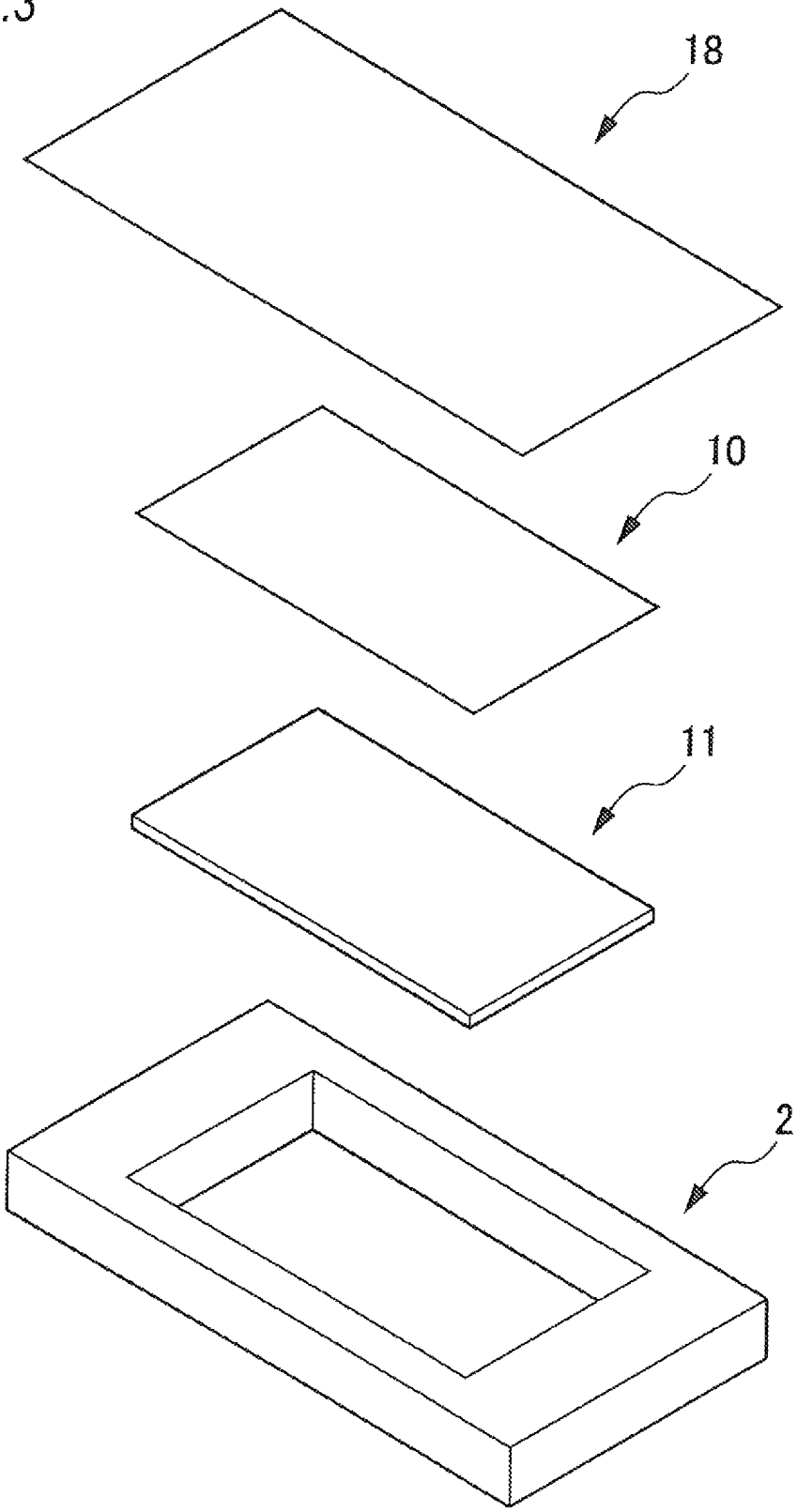
FIG. 3 is an exploded perspective view illustrating a configuration of a touch panel according to the illustrative embodiment.

FIG. 3 is an exploded perspective view illustrating a configuration of the touch panel 10 according to the illustrative embodiment. As shown in FIG. 3, the display unit 11, the touch panel 10, and a hard coating layer 18 are sequentially laminated on the housing 2.

Figure 4:
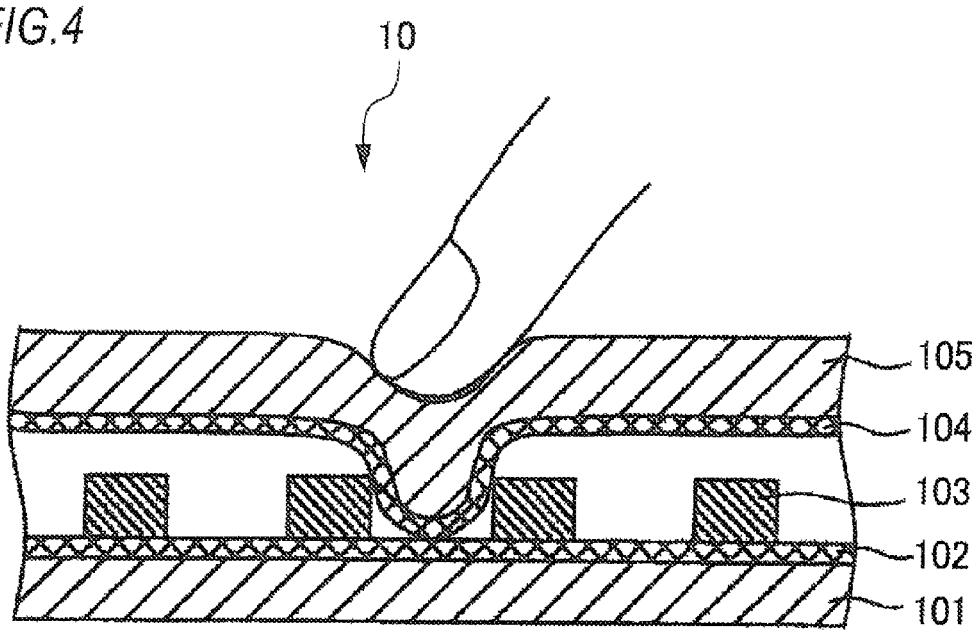
FIG. 4 is a cross-sectional view illustrating a configuration of the touch panel of FIG. 3.

FIG. 4 is a cross-sectional view illustrating a configuration of the touch panel 10 of FIG. 3. As shown in FIG. 4, the touch panel 10 includes a glass substrate 101, an Indium Tin Oxide (ITO) film 102, a dot spacer 103, an ITO film 104, and a surface film 105. In the illustrative embodiment, a resistive type touch panel is employed and it will be described. Even though other members may be included in the touch panel 10, descriptions thereof will be omitted for brevity.

The glass substrate 101 and the surface film 105 are disposed to face each other, and the ITO film 102, the dot spacer 103, and the ITO film 104 are formed between the glass substrate 101 and the surface film 105. The dot spacer 103 is formed between the ITO films 102 and 104 to prevent, for example, an erroneous contact between the ITO films 102 and 104.

FIG. 4 illustrates a state in which a portion of the surface film 105 is touched with a finger. In this case, the ITO film 102 contacts with the ITO film 104 at a touch point. The touch panel 10 detects an X coordinate and a Y coordinate of the touch point as described below.

When detecting the X coordinate of the touch point, voltage is applied to an X-axial direction of the ITO film 102, so that the ITO films 102 and 104 are conducted at the touch point. In this instance, a voltage gradient occurs between electrodes 102*a* and 102*b* (see FIG. 5) of the ITO film 102. The control unit 17 detects the X coordinate of the touch point based on a signal with respect to a voltage dividing that is obtained from the voltage at the touch point detected on the side of the glass substrate 101.

When detecting the Y coordinate of the touch point, voltage is applied to a Y-axial direction of the ITO film 102, so that the ITO films 102 and 104 are conducted at the touch point. In this instance, a voltage gradient occurs between electrodes 104*a* and 104*b* (see FIG. 5) of the ITO film 104. The control unit 17 detects the Y coordinate of the touch point based on a signal with respect to a voltage dividing that is obtained from the voltage at the touch point detected on the side of the glass substrate 101.

Figure 5:
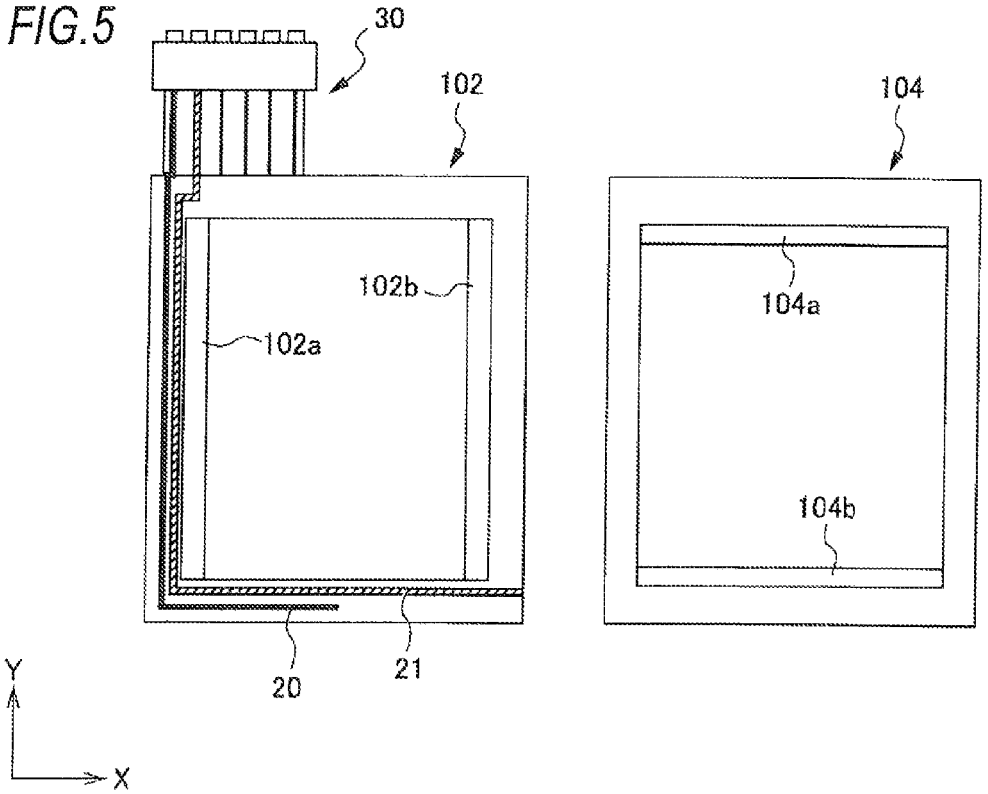
FIG. 5 illustrates one example of disposing an antenna pattern on a touch panel according to the illustrative embodiment.

FIG. 5 is a view illustrating one example of disposing the antenna pattern 20 on the touch panel 10 according to an illustrative embodiment. For brevity of description, description relating to the dot spacer 103 will be omitted in the following description. As shown in FIG. 5, it is formed a flexible substrate 30 to electrically contacts with the ITO film 102 and a circuit substrate (not shown) mounted with the control unit 17. Even though not illustrated, the flexible substrate 30 is also electrically connected to the ITO film 104.

The antenna pattern 20 configures the main antenna formed on the periphery of the ITO film 102 of the touch panel 10. In this illustrative embodiment, the antenna pattern 20 is formed along the left and lower periphery (X axial and Y axial directions) of the ITO film 102, and is formed in an L shape.

According to the configuration, the antenna pattern 20 is formed on the periphery of the touch panel 10 of the mobile phone 1, so that it is possible to reduce a positional restriction of disposing an antenna in a situation where a space for disposing the antenna within the housing 2 cannot be secured. The mobile phone 1 may form the antenna pattern 20 by forming the antenna pattern 20 on the periphery of the ITO film 102.

As shown in FIG. 5, the touch panel 10 includes a reference potential pattern 21 formed between the electrode 102*a* (operation detecting pattern) and the antenna pattern 20. The reference potential pattern 21 is formed in an L shape along the antenna pattern 20. A length of the reference potential pattern 21 is longer than that of the antenna pattern 20.

According to the above configuration, the mobile phone 1 may be suppressed a magnetic coupling between the electrodes 102*a* and 102*b* of the touch panel 10 and the antenna pattern 20 by the reference potential pattern 21. Therefore, it is possible to suppress an antenna characteristic of the antenna pattern 20 from being degraded.

Figure 6:
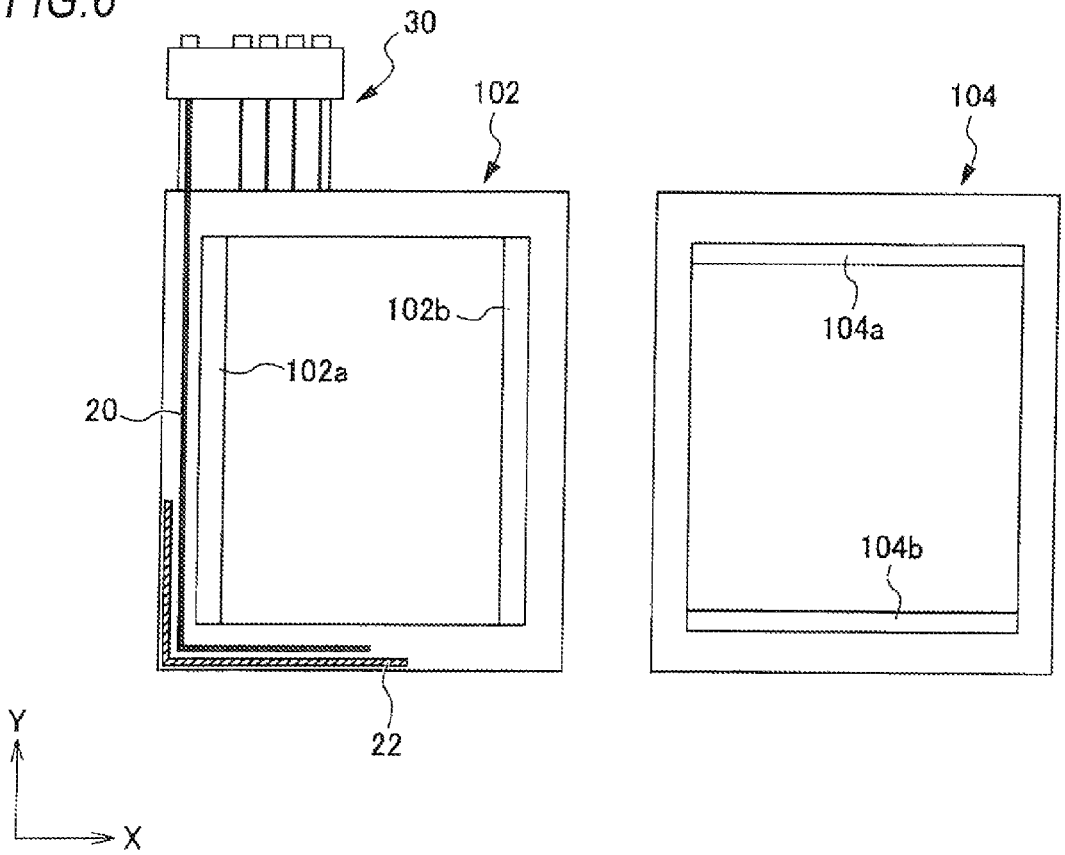
FIG. 6 illustrates one other example of disposing an antenna pattern on a touch panel according to the illustrative embodiment.

FIG. 6 is a view illustrating one other example of disposing the antenna pattern 20 on the touch panel 10 according to an illustrative embodiment. As shown in FIG. 6, the touch panel 10 includes a parasitic element 22 that is formed on the periphery of the ITO film 102 and is disposed at an outer side of the ITO film 102 compared to the antenna pattern 20. The parasitic element 22 is formed in an L shape along the antenna pattern 20. A length of the parasitic element 22 is shorter than that of the antenna pattern 20. The parasitic element 22 is configured by, for example, metal.

The mobile phone 1 according to this example enables the directivity of the antenna pattern 20 to direct toward not the electrodes 102*a* and 102*b* of the antenna pattern 20 and but to direct toward the parasitic element 22 by the parasitic element 22. Therefore, it is possible to improve an antenna characteristic of the antenna pattern 20.

Figure 7:
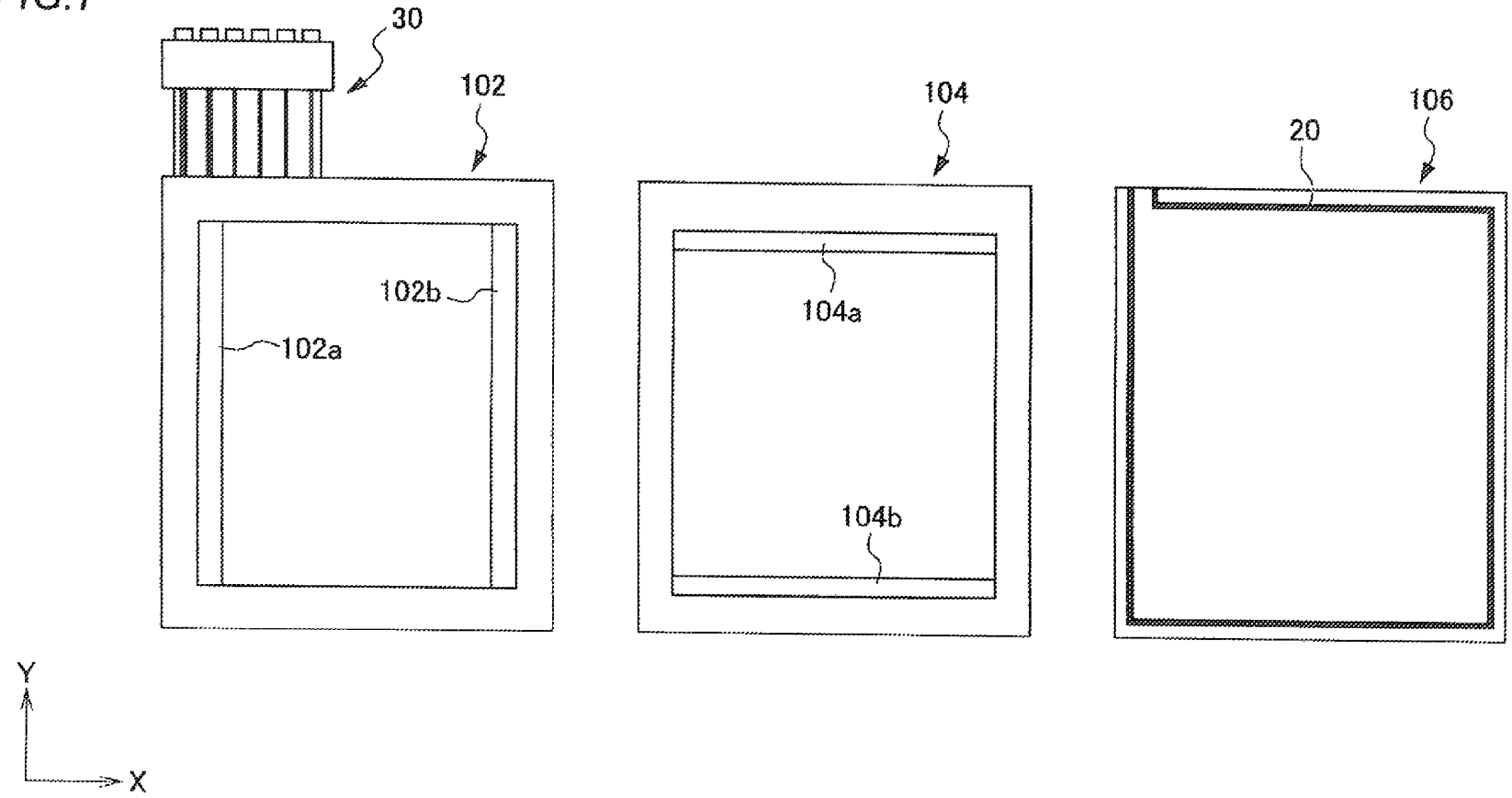
FIG. 7 illustrates one other example of disposing an antenna pattern on a touch panel according to the illustrative embodiment.

FIG. 7 is a view illustrating one other example of disposing the antenna pattern 20 on the touch panel 10 according to an illustrative embodiment. As shown in FIG. 7, the touch panel 10 may be installed separately from the ITO films 102 and 104 and may include a sheet 106 for forming the antenna pattern 20.

The antenna pattern 20 having a loop shape is formed on the periphery of the sheet 106. The antenna pattern 20 is electrically connected to a circuit substrate (not shown), in which the control unit 17 is installed, by the flexible substrate 30, for example.

Figure 8:
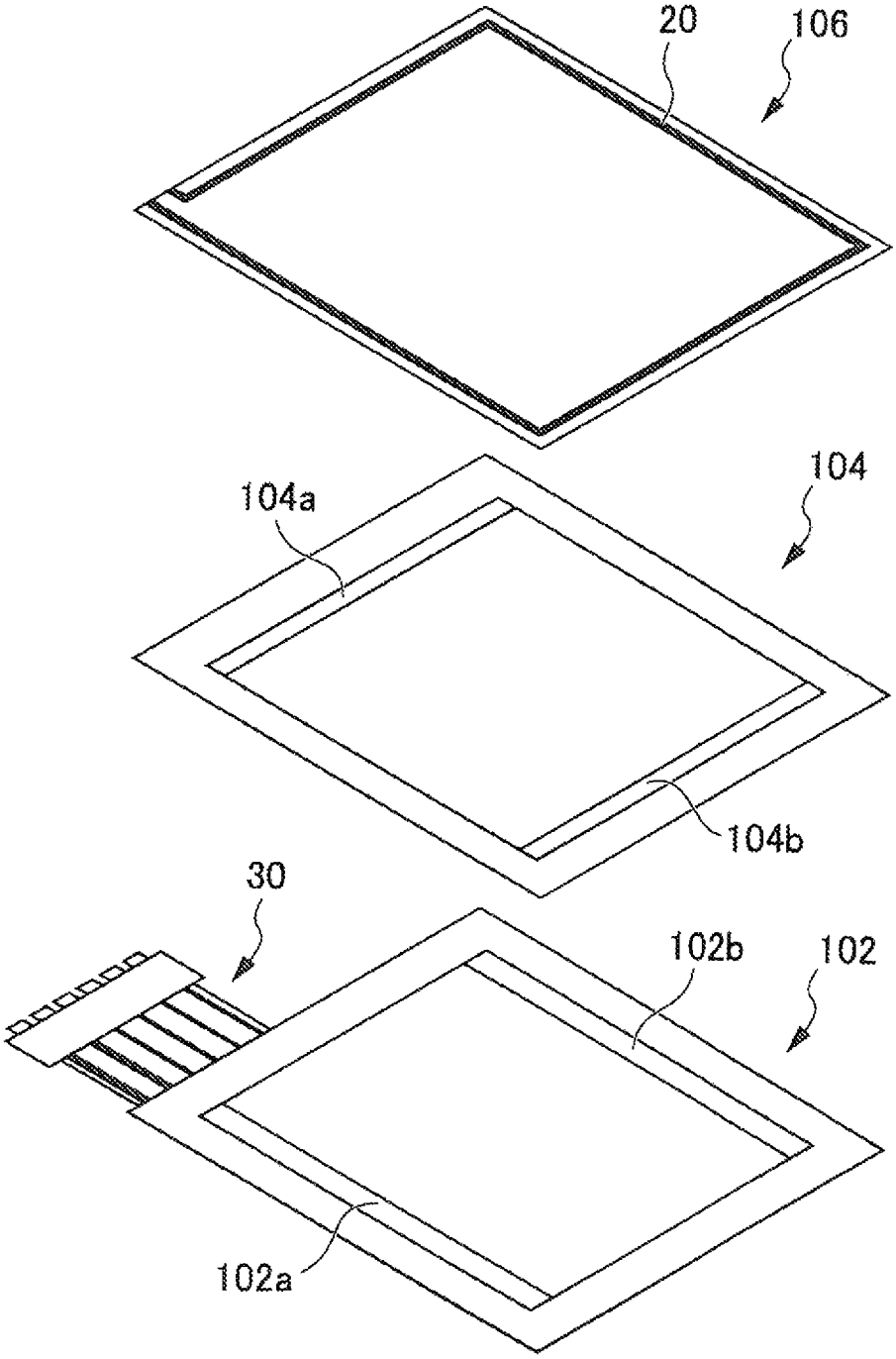
FIG. 8 is an exploded perspective view illustrating a configuration of the touch panel of FIG. 7.

FIG. 8 is an exploded perspective view illustrating a configuration of the touch panel 10 of FIG. 7. As shown in FIG. 8, the touch panel 10 is formed in a multi-layered configuration by laminating, in the order of the ITO film 102, the ITO film 104, and the sheet 106.

Figure 9:
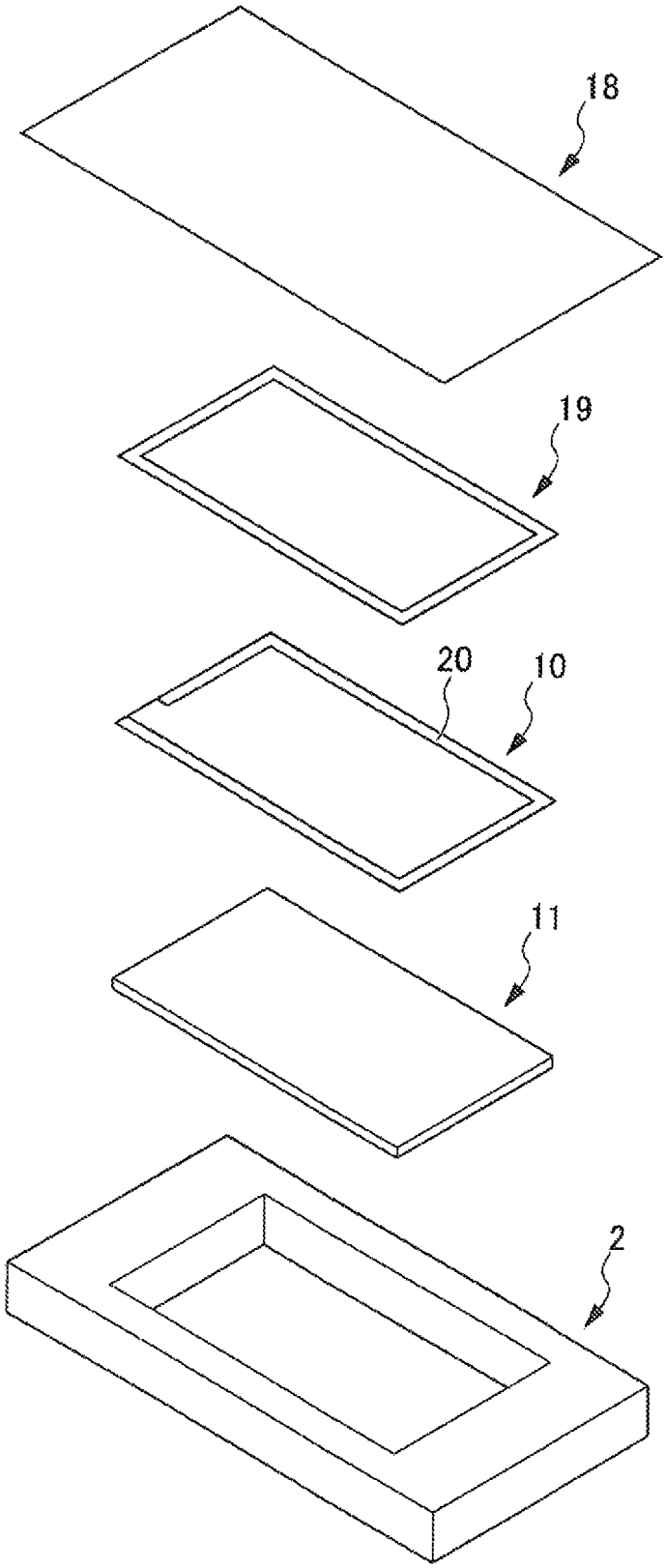
FIG. 9 is an exploded perspective view illustrating one other example of disposing an antenna pattern on a touch panel according to the illustrative embodiment.

FIG. 9 is an exploded perspective view illustrating one other example of disposing the antenna pattern 20 on the touch panel 10 according to the illustrative embodiment. As shown in FIG. 9, the display unit 11, the touch panel 10, and the hard coating layer 18 are sequentially laminated on the housing 2 and disposed, as in FIG. 3. In the example of FIG. 9, a magnetic sheet 19 is formed between the touch panel 10 and the hard coating layer 18 (or the surface film 105 of the touch panel 10).

The magnetic sheet 19 may be formed a dust-proof sponge, which suppresses dusts from infiltrating into a gap between the touch panel 10 and the hard coating layer 18, by containing a magnetic material. The antenna pattern 20 is formed in a loop shape.

Figure 10:
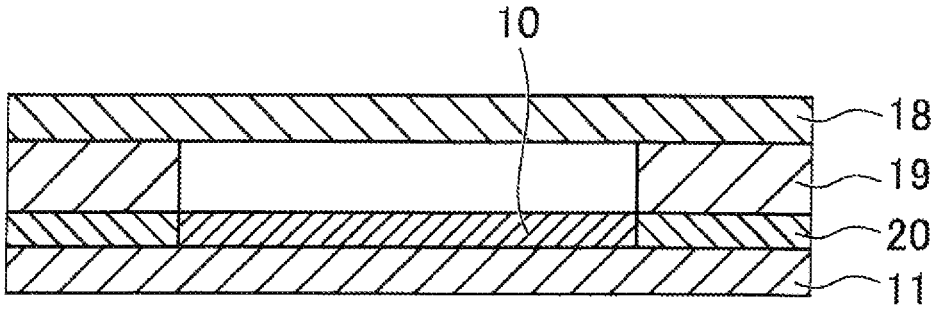
FIG. 10 is a cross-sectional view illustrating a configuration of the touch panel of FIG. 9.

FIG. 10 is a cross-sectional view illustrating a configuration of the touch panel 10 of FIG. 9. As shown in FIG. 10, the magnetic sheet 19 is disposed at the periphery of the touch panel 10 and the hard coating layer 18. That is, the magnetic sheet 19 is disposed at a position overlapping with the antenna pattern 20 in a thickness direction of the touch panel 10.

In the mobile phone 1 configured as above, when the antenna pattern 20 is designed to be a loop antenna used for a non-contact communication with an external reader/writer, magnetic flux coming from an outside (external coating layer 18) is guided by the magnetic sheet 19 and is guided through the magnetic sheet 19 to an area surrounded by the antenna pattern 20 in a planar direction of the touch panel 10. Accordingly, the mobile phone 1 may improve the antenna characteristic of the antenna pattern 20 by installing the magnetic sheet 19.

Figure 11:
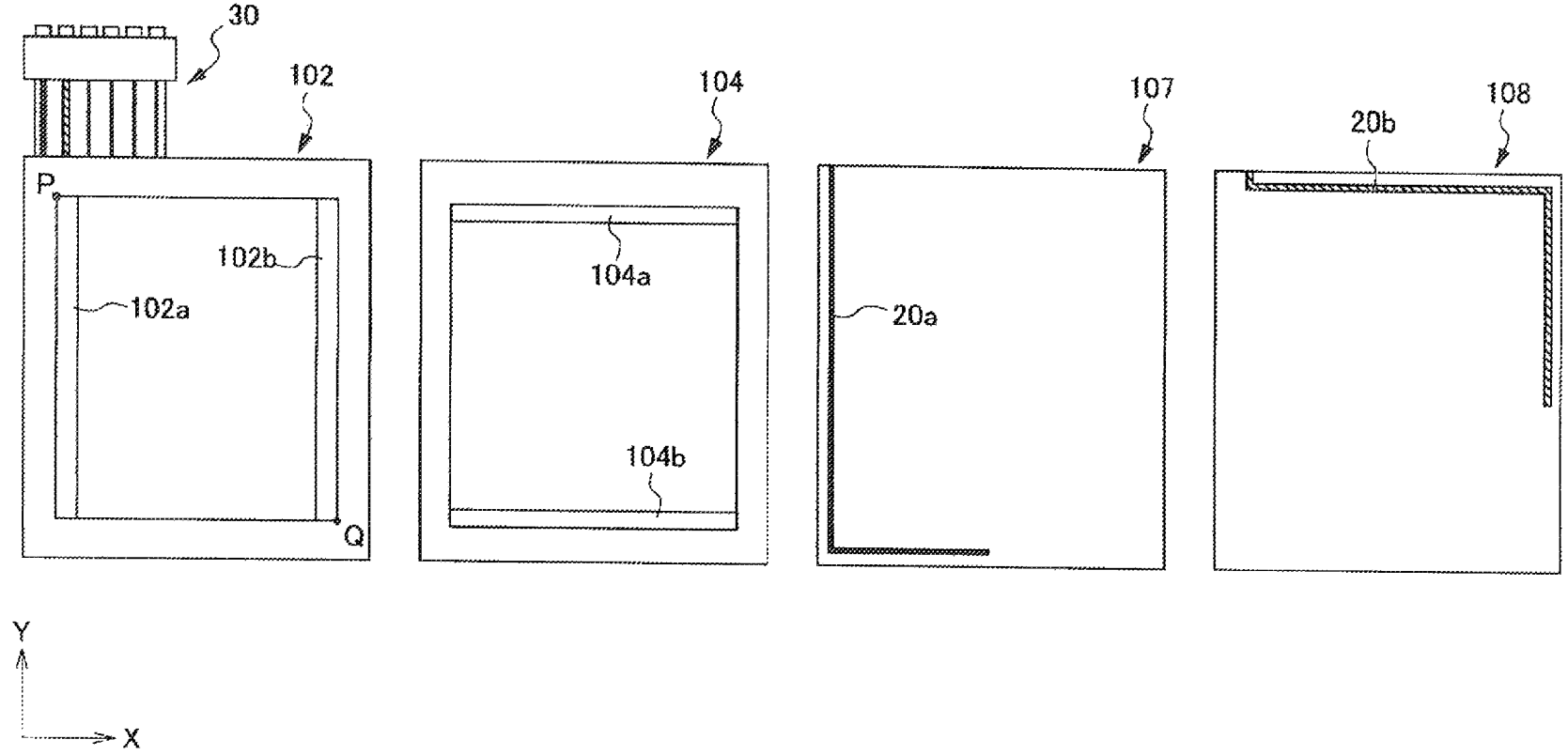
FIG. 11 is a view illustrating one other example of disposing an antenna pattern on a touch panel according to the illustrative embodiment.

FIG. 11 is a view illustrating one other example of disposing the antenna pattern 20 on the touch panel 10 according to the illustrative embodiment. As shown in FIG. 11, the touch panel 10 may include the ITO films 102 and 104, and sheets 107 and 108. An antenna pattern 20*a* is formed on the sheet 107 and an antenna pattern 20*b* is formed on the sheet 108.

Specifically, the antenna pattern 20*a* is formed along the left periphery and the lower periphery of the sheet 107, and is formed in an L shape. The antenna pattern 20*b* is formed along the upper periphery and the right periphery of the sheet 108 and is formed in an L shape. That is, the antenna patterns 20*a* and 20*b* are disposed at a position to not overlapping with each other in the thickness direction of the touch panel 10.

Figure 12:
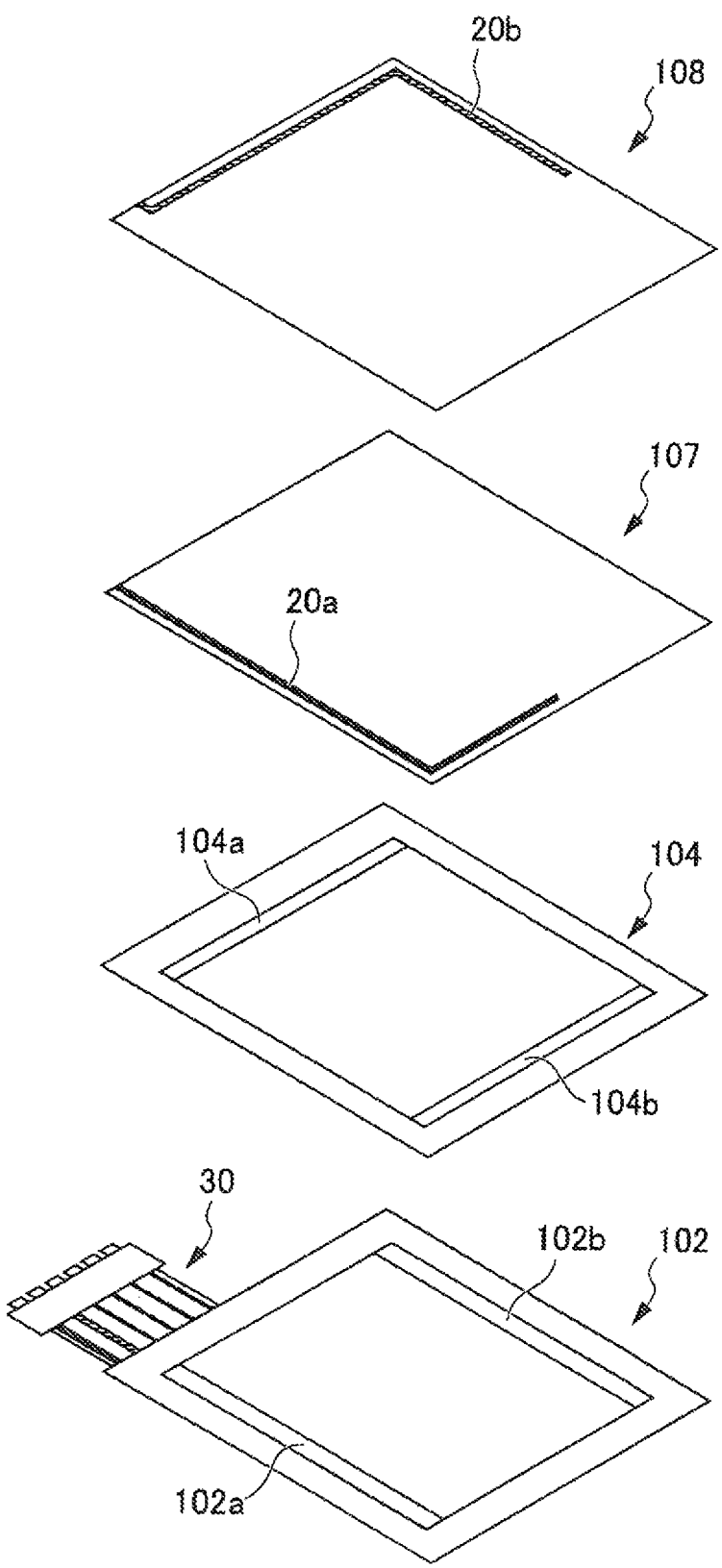
FIG. 12 is an exploded perspective view illustrating a configuration of the touch panel of FIG. 11.

FIG. 12 is an exploded perspective view illustrating a configuration of the touch panel 10 of FIG. 11. As shown in FIG. 11, the touch panel 10 is provided by laminating, in order of the ITO film 102 and the ITO film 104, and the sheets 107 and 108.

The control unit 17 of FIG. 2 switches a destination of power supply between the antenna patterns 20*a* and 20*b* based on a position of a touch operation detected on the ITO films 102 and 104.

Specifically, when a touch position is closer to the antenna pattern 20*a* than the antenna pattern 20*b* in the ITO films 102 and 104 (for example, in an area of a side of the electrode 102*a* with respect to a line connecting points P and Q in FIG. 11), the control unit 17 supplies power to the antenna pattern 20*b*.

Meanwhile, when the touch position is closer to the antenna pattern 20*b* than the antenna pattern 20*a* in the ITO films 102 and 104 (for example, in an area of a side of the electrode 102*b* with respect to the line connecting the points P and Q of FIG. 11), the control unit 17 supplies power to the antenna pattern 20*a*.

The antenna pattern 20*a* or 20*b* close to the position, at which the touch is detected, may be covered with the hand. Therefore, the mobile phone 1 may supply the power to an antenna pattern located at a side opposite to the position, at which the touch is detected, thereby suppressing the degradation of the antenna characteristic due to covering by a human body.

The control unit 17 may determine one of the antenna patterns 20*a* and 20*b* to supply power based on a situation of a frequency being used. Accordingly, the mobile phone 1 may use the antenna patterns 20*a* and 20*b* as an antenna for a diversity purpose or multiple input and multiple output (MIMO) purpose.

Figure 13:
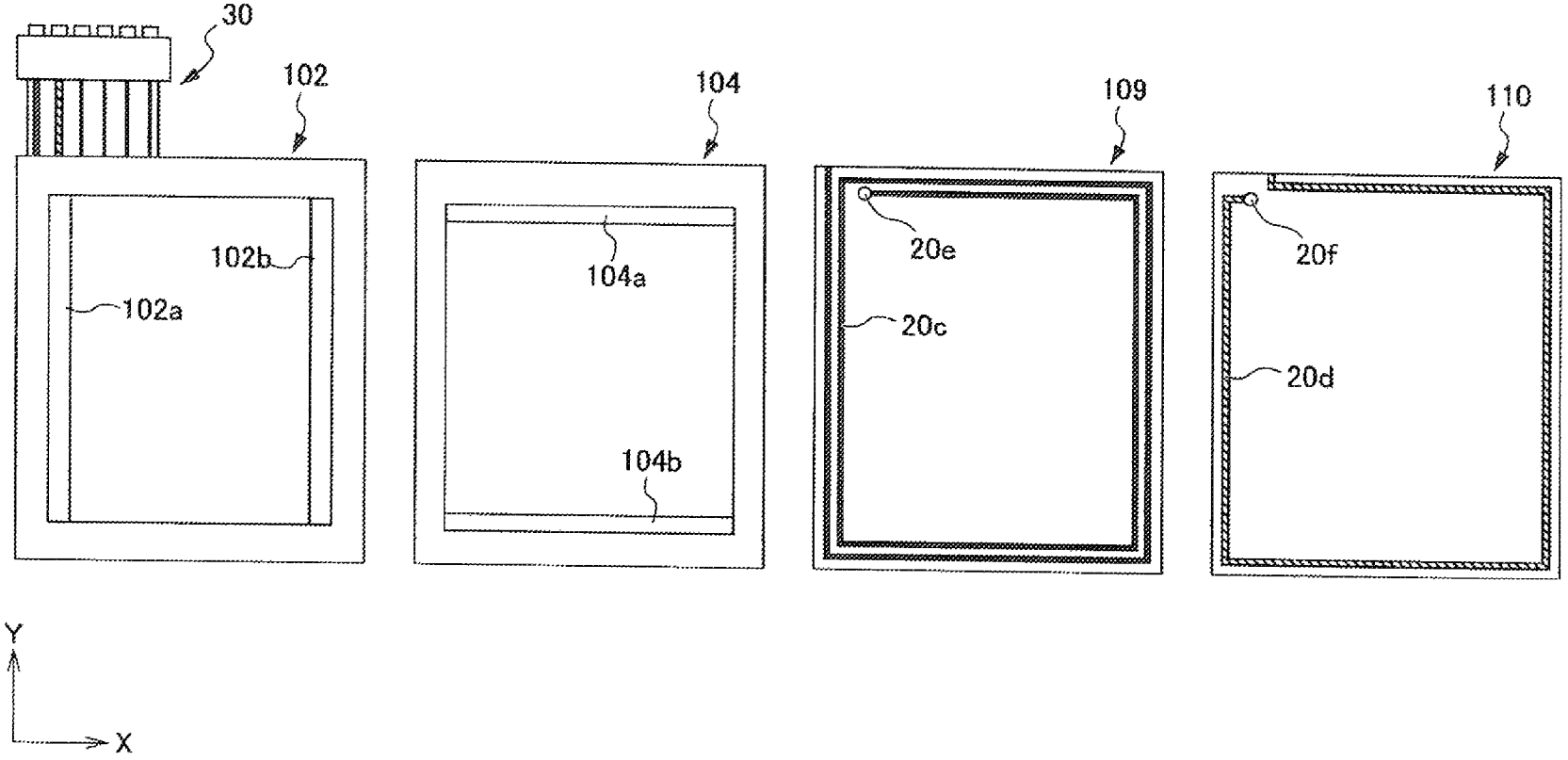
FIG. 13 is a view illustrating one other example of disposing an antenna pattern on a touch panel according to the illustrative embodiment.

FIG. 13 is a view illustrating one other example of disposing the antenna pattern 20 on the touch panel 10 according to an illustrative embodiment. As shown in FIG. 13, the touch panel 10 may include the ITO films 102 and 104, and sheets 109 and 110.

On the sheet 109, an antenna pattern 20*c* has a loop shape that is winded two times at the periphery of the sheet 109. On the sheet 110, an antenna pattern 20*d* has a loop shape that is winded one time at the periphery of the sheet 110.

The sheets 109 and 110 are laminated and disposed similarly to the sheets 107 and 108 of FIG. 12.

A connecting portion 20*e* which electrically connects the antenna patterns 20*c* and 20*d* is formed at one end of the antenna pattern 20*c*. Similarly, a connecting portion 20*f* which electrically connects the antenna patterns 20*c* and 20*d* is formed at one end of the antenna pattern 20*d*. The connecting portions 20*e* and 20*f* are made of a conductive material such as metal and are electrically connected to each other.

In the mobile phone 1 according to the illustrative embodiment, the antenna patterns 20*c* and 20*d* are formed on sheets different from both of the ITO films 102 and 104, and include the connecting portions 20*e* and 20*f* which electrically connect the antenna patterns 20*c* and 20*d*, respectively. Accordingly, the mobile phone 1 may form a three-dimensional and complex antenna pattern by electrically connecting the antenna patterns 20*c* and 20*d*, so that the mobile phone 1 easily responds to multiple frequencies. The antenna pattern 20*c* may be formed on the ITO film 102, and the antenna pattern 20*d* may be formed on the ITO film 104. According to that configuration, the touch panel 10 may be thinned, and then the mobile phone 1 may be thinned.

As shown in FIGS. 11 to 13, the antenna pattern 20 (20*a*, 20*b*, 20*c*, and 20*d*) is formed on the periphery of the touch panel 10 and is disposed at a position invisible from the outside of the housing 2, preferably. Accordingly, the mobile phone 1 may reduce a positional restriction in a case of disposing the antenna pattern 20 within the housing 2, without losing the visibility of the touch panel 10.

The illustrative embodiment of this disclosure is described above. However, this disclosure is not limited thereto and may be appropriately modified. The mobile phone is described as the electronic device in the aforementioned illustrative embodiment. However, this disclosure may also be applied to other types of electronic devices. For example, the electronic device of this disclosure is a digital camera, a personal handy phone system (Japanese registered trademark: PHS), a personal digital assistant (PDA), a portable navigation device, a personal computer, a note-type PC, or a portable game device.

An antenna pattern is formed in a peripheral area with respect to a detection pattern in a planar direction of an ITO film or another sheet in the aforementioned illustrative embodiment However, this disclosure is not limited thereto. For example, the antenna pattern may be formed by using a deposition onto the periphery of an insulating body that configures a portion of the outer surface of the touch panel disposed between ITO films, so that the antenna pattern may be formed on an outer edge portion of the touch panel in the planar direction.

What is claimed is:

1. An electronic device comprising:

an antenna;

a touch panel having an electrode sheet formed with an operation detecting pattern, which is conductive; and a reference potential pattern formed on the touch panel between the operation detecting pattern and an antenna pattern, wherein the antenna pattern configuring the antenna is formed on the periphery of the touch panel, and the electrode sheet is configured by:

a first electrode sheet formed with a first operation detecting pattern; and a second electrode sheet formed with a second operation detecting pattern, the first operation detecting pattern detects an operation position in a first direction along a planar direction of the electrode sheet, and the second operation detecting pattern detects the operation position in a second direction, which is different from the first direction, along the planar direction of the electrode sheet, and the antenna pattern includes:

a first antenna pattern formed on the first electrode sheet; and a second antenna pattern formed on the second electrode sheet, and the first antenna pattern is electrically connected to the second antenna pattern.

2. The electronic device according to claim 1, wherein the antenna pattern is formed in an outer area of the operation detecting pattern on the electrode sheet.

3. The electronic device according to claim 1, wherein the operation detecting pattern, the reference potential pattern, and the antenna pattern are arranged in order from the operation detecting pattern to an end of the electronic device in a planar direction along the touch panel.

4. The electronic device according to claim 1, further comprising a parasitic element disposed at an outer area of the antenna pattern on the electrode sheet.

5. The electronic device according to claim 1, further comprising a magnetic material, wherein the magnetic material is disposed at a position overlapping with the antenna pattern in a thickness direction of the touch panel, and wherein the antenna pattern is formed to have a loop shape along the periphery of the touch panel.

6. The electronic device according to claim 1, wherein the antenna pattern includes a first antenna pattern and a second antenna pattern, and wherein the electronic device further includes a control unit that switches a destination of power supply between the first antenna pattern and the second antenna pattern.

7. The electronic device according to claim 1, wherein the touch panel includes a first sheet and a second sheet that are laminated on the electrode sheet, wherein the antenna pattern is configured by:

a first antenna pattern formed on the first sheet; and a second antenna pattern formed on the second sheet, and wherein the first antenna pattern is electrically connected with the second antenna pattern.

8. The electronic device according to claim 1, further comprising a housing formed with an opening, wherein at least one area of the touch panel is overlapped with the opening in a thickness direction of the touch panel, and wherein the antenna pattern is formed in another area of the touch panel, which is overlapped with the housing in the thickness direction of the touch panel.

* * * * *